US011474551B1

(12) United States Patent
Tan et al.

(10) Patent No.: US 11,474,551 B1
(45) Date of Patent: Oct. 18, 2022

(54) LOW-DROPOUT LINEAR REGULATOR AND CONTROL SYSTEM

(71) Applicant: Halo Microelectronics Co., Ltd., Foshan (CN)

(72) Inventors: Xiaoliang Tan, Foshan (CN); Chuang Lan, Foshan (CN); Guanhua Li, Foshan (CN)

(73) Assignee: Halo Microelectronics Co., Ltd., Foshan (CN)

( * ) Notice: Subject to any disclaimer, the term of this patent is extended or adjusted under 35 U.S.C. 154(b) by 0 days.

(21) Appl. No.: 17/708,090

(22) Filed: Mar. 30, 2022

(30) Foreign Application Priority Data

Jun. 4, 2021 (CN) ..... 202110626048.3

(51) Int. Cl.
*G05F 1/59* (2006.01)
*G05F 1/565* (2006.01)

(52) U.S. Cl.
CPC ..... *G05F 1/59* (2013.01); *G05F 1/565* (2013.01)

(58) Field of Classification Search
CPC ..... G05F 1/59; G05F 1/565
See application file for complete search history.

(56) References Cited

U.S. PATENT DOCUMENTS

2013/0307502 A1* 11/2013 Bhattacharyya ..... G05F 1/565 323/282
2014/0002049 A1 1/2014 Schrom et al.
2021/0026384 A1* 1/2021 Jin ..... G05F 1/575
2021/0208616 A1* 7/2021 Gheorghiu ..... G05F 1/575

FOREIGN PATENT DOCUMENTS

CN 105242736 A 1/2016
CN 105573396 A 5/2016
EP 3249491 A1 11/2017

* cited by examiner

*Primary Examiner* — Kyle J Moody
*Assistant Examiner* — Lakaisha Jackson
(74) *Attorney, Agent, or Firm* — Slater Matsil, LLP

(57) ABSTRACT

A regulator includes an error amplification module, a first switch module, an adaptive conduction module, a second switch module and a feedback module. A first voltage difference between the second terminal and the third terminal of the first switch module is adjusted by the first switch module. The adaptive conduction module is used to adjust a second voltage difference between the second terminal and the third terminal of the second switch module. When the load current is less than a preset current threshold, the control voltage signal controls the first switch module to turn on, and the adaptive conduction module controls the second switch module to turn off. When the load current is greater than or equal to the preset current threshold, the control voltage signal controls the first switch module to turn on and controls the second switch module to be turned on through the adaptive conduction module.

14 Claims, 4 Drawing Sheets

LOW-DROPOUT LINEAR REGULATOR AND CONTROL SYSTEM

PRIORITY CLAIM

This application claims the benefit of and priority to Chinese Patent Application No. 202110626048.3, filed on Jun. 4, 2021, which is hereby incorporated by reference in its entirety.

TECHNICAL FIELD

The invention relates to the technical field of electronic circuits, in particular to a low-dropout linear regulator and control system.

BACKGROUND

Among power supplies, Low Dropout Regulator (LDO) is widely used in different output voltage domains due to the advantages of less peripheral components, low output noise, low output ripple, a simple circuit structure and the like. In today's increasingly demanding low power applications, low-dropout linear regulators not only need to have a strong load driving capacity, but also need to maintain extremely low static power consumption to extend the battery life of mobile devices.

In the circuit of low-dropout linear regulator designs, in order to ensure the stability of the regulation loop of low-dropout linear regulators under different load conditions, it is necessary to perform stability compensation on the circuit of the low-dropout linear regulator. In the prior art, in order to maintain the loop stability of the low-dropout linear regulator and improve its dynamic response under the condition of low static power consumption, the load current sampling technology is usually used.

However, due to changes in temperature, process parameters, peripheral components, and mismatches in the production process, the pole frequency of the regulation loop will change significantly. It is difficult to ensure that the dynamic zero and the output pole are completely matched in the full load range. As a result, the load current sampling technology is more difficult to realize the loop compensation, and there is a risk of instability.

SUMMARY

The embodiment of the present invention aims to provide a low-dropout linear regulator and control system, which can simultaneously realize loop stability and lower static power consumption across a wider load current range in a relatively simple way.

In order to achieve the above objectives, in the first aspect, the present invention provides a low-dropout linear regulator including an error amplification module, a first switch module, an adaptive conduction module, a second switch module and a feedback module.

An input terminal of the error amplification module is connected to a first terminal of the feedback module, and the error amplification module is configured to output a control voltage signal according to a feedback signal output by the feedback module.

A first terminal of the first switch module is connected to an output terminal of the error amplification module. A second terminal of the first switch module is connected to a first power supply, and the first switch module adjusts a first voltage difference between the second terminal and a third terminal of the first switch module according to the control voltage signal;

A first terminal of the adaptive conduction module is connected to the output terminal of the error amplification module. A second terminal of the adaptive conduction module is connected to a second power supply. A third terminal of the adaptive conduction module is connected to a first terminal of the second switch module. A second terminal of the second switch module is connected to the first power supply. The adaptive conduction module is used to perform an adaptive potential conversion on the control voltage signal to adjust a second voltage difference between the second terminal and a third terminal of the second switch module.

The third terminal of the first switch module is connected to the third terminal of the second switch module, a second terminal of the feedback module and the load. The connection node between the third terminal of the first switch module, the third terminal of the second switch module, the second terminal of the feedback module and the load is a first connection node. The feedback signal is obtained by the feedback module according to the voltage on the first connection node.

When the load current is less than a preset current threshold, the control voltage signal controls the first switch module to turn on, and the adaptive conduction module controls the second switch module to turn off to adjust the voltage on the first connection node based on the first voltage difference.

When the load current is greater than or equal to the preset current threshold, the control voltage signal controls the first switch module to be turned on, and the adaptive conduction module controls the second switch module to be turned on to adjust the voltage at the first connection node based on the first voltage difference and the second voltage difference.

Optionally, the first switch module includes a first MOSFET. A control terminal of the first MOSFET is connected to the output terminal of the error amplification module. A first terminal of the first MOSFET is connected to the second power supply. A second terminal of the first MOSFET is connected to the first connection node.

Optionally, the adaptive conduction module includes a second MOSFET, a third MOSFET, a first current source, and a second current source. A control terminal of the second MOSFET is connected to the output terminal of the error amplification module. A first terminal of the second MOSFET is connected to an anode (a positive terminal) of the first current source and a second terminal of the third MOSFET. A cathode (a negative terminal) of the first current source is connected to the second power supply. A second terminal of the second MOSFET is connected to a cathode of the second current source and a control terminal of the third MOSFET. A first terminal of the third MOSFET and an anode of the second current source are both grounded. The control terminal of the second MOSFET is the first terminal of the adaptive conduction module. The cathode of the first current source is the second terminal of the adaptive conduction module, and the anode of the first current source is the third terminal of the adaptive conduction module.

Optionally, the second switch module includes a fourth MOSFET. A control terminal of the fourth MOSFET is connected to the anode of the first current source. A first terminal of the fourth MOSFET is connected to the first power supply. A second terminal of the fourth MOSFET is connected to the first connection node.

Optionally, the first MOSFET is a PMOS. The gate of the PMOS is the control terminal of the first MOSFET. The source of the PMOS is the first terminal of the first MOSFET. The drain of the PMOS is the second terminal of the first MOSFET.

The second MOSFET is a PMOS. The gate of the PMOS is the control terminal of the second MOSFET. The source of the PMOS is the first terminal of the second MOSFET. The drain of the PMOS is the second terminal of the second MOSFET.

The third MOSFET is an NMOS. The gate of the NMOS is the control terminal of the third MOSFET. The source of the NMOS is the first terminal of the third MOSFET. The drain of the NMOS is the second terminal of the third MOSFET.

The fourth MOSFET is a PMOS. The gate of the PMOS is the control terminal of the fourth MOSFET. The source of the PMOS is the first terminal of the fourth MOSFET. The drain of the PMOS is the second terminal of the fourth MOSFET.

Optionally, the current of the second current source is used to control the voltage between the gate and the source of the second MOSFET, so that the first MOSFET and the fourth MOSFET starts to conduct under different voltage values of the control signal.

Optionally, the size of the first MOSFET is smaller than the size of the fourth MOSFET.

Optionally, the error amplification module includes a first error amplifier. A non-inverting input terminal of the first error amplifier is connected to the first terminal of the feedback module. An inverting input terminal of the first error amplifier is connected to a first reference voltage source. An output terminal of the first error amplifier is connected to the first terminal of the first switch module and the first terminal of the adaptive conduction module.

Optionally, the adaptive conduction module includes a fifth MOSFET, a sixth MOSFET, a third current source, and a fourth current source. A control terminal of the fifth MOSFET is connected to the output terminal of the error amplification module. A first terminal of the fifth MOSFET is connected to a cathode of the fourth current source and a second terminal of the sixth MOSFET. A second terminal of the fifth MOSFET is connected to a control terminal of the sixth MOSFET and an anode of the third current source. A first terminal of the sixth MOSFET is connected to a cathode of the third current source and the first power supply. An anode of the fourth current source is grounded. The control terminal of the fifth MOSFET is the first terminal of the adaptive conduction module. The cathode of the third current source is the second terminal of the adaptive conduction module. The cathode of the fourth current source is the third terminal of the adaptive conduction module.

Optionally, the second switch module includes a seventh MOSFET.

A control terminal of the seventh MOSFET is connected to the cathode of the fourth current source. A first terminal of the seventh MOSFET is connected to the first connection node. A second terminal of the seventh MOSFET is connected to the second power supply.

Optionally, the first MOSFET is an NMOS. The gate of the NMOS is the control terminal of the first MOSFET. The drain of the NMOS is the first terminal of the first MOSFET. The source of the NMOS is the second terminal of the first MOSFET.

The fifth MOSFET is an NMOS. The gate of the NMOS is the control terminal of the fifth MOSFET. The source of the NMOS is the first terminal of the fifth MOSFET. The drain of the NMOS is the second terminal of the fifth MOSFET.

The sixth MOSFET is a PMOS. The gate of the PMOS is the control terminal of the sixth MOSFET. The source of the PMOS is the first terminal of the sixth MOSFET. The drain of the PMOS is the second terminal of the sixth MOSFET.

The seventh MOSFET is an NMOS. The gate of the NMOS is the control terminal of the seventh MOSFET. The source of the NMOS is the first terminal of the seventh MOSFET. The drain of the NMOS is the second terminal of the seventh MOSFET.

Optionally, the error amplification module includes a second error amplifier. An inverting input terminal of the second error amplifier is connected to the first terminal of the feedback module. A non-inverting input terminal of the second error amplifier is connected to a second reference voltage source, and an output terminal of the second error amplifier is connected to the first terminal of the first switch module and the first terminal of the adaptive conduction module.

Optionally, the feedback module includes a first resistor and a second resistor. The first resistor and the second resistor are connected in series. The non-series connection terminal of the first resistor is connected to the first connection node. The connection node between the first resistor and the second resistor is connected to the input terminal of the error amplification module. The non-series connection terminal of the second resistor is grounded. The connection node between the first resistor and the second resistor is the first terminal of the feedback module.

Optionally, the low-dropout linear regulator further includes a compensation module. A first terminal of the compensation module is connected to the compensation terminal of the error amplification module. A second terminal of the compensation module is connected to the first connection node. The compensation module is used to adjust zero and pole of the low-dropout linear regulator.

In a second aspect, an embodiment of the present application provides a control system including a load and the low-dropout linear regulator as described above. The low-dropout linear regulator is connected to the load, and the low-dropout linear regulator is used to provide voltage and current to the load.

The beneficial effects of the embodiments of the present invention are: the low-dropout linear regulator provided by the present invention includes an error amplification module, a first switch module, an adaptive conduction module, a second switch module and a feedback module. The error amplification module is used to output a control voltage signal according to the feedback signal generated by the feedback module. The first switch module adjusts the first voltage difference between the second terminal and the third terminal of the first switch module according to the control voltage signal. The adaptive conduction module is used to perform adaptive potential conversion on the control voltage signal to adjust the second voltage difference between the second terminal and the third terminal of the second switch module. When the load current is less than the preset current threshold, the control voltage signal controls the first switch module to turn on, and the second switch module is controlled to turn off through the adaptive conduction module to adjust the voltage at the first connection node based on the first voltage difference. When the load current is greater than or equal to the preset current threshold, the control voltage signal controls the first switch module to turn on, and the adaptive conduction module controls the second switch module to turn on, so as to adjust the voltage at the first connection node based on the first voltage difference and the second voltage difference. Therefore, when the current required by the load connected to the low-dropout linear regulator is small, the control voltage signal only controls the first switch module to turn on, which is enough to provide a stable output voltage that can effectively control the static power consumption. When the current required by the load connected to the low-dropout linear regulator is large, the control signal is less than the preset threshold. At this time, based on the conduction of the first switch module, the control voltage signal can turn on the second switch module through the conversion by the adaptive conduction module, so as to provide more current to the load such that the load can operate stably. Through the above-mentioned method, loop stability and lower static power consumption in a wider load current range can be realized simultaneously in a relatively simple manner.

BRIEF DESCRIPTION OF THE DRAWINGS

One or more embodiments are exemplified by the drawings in the corresponding drawings. These exemplified descriptions do not constitute a limitation on the embodiments. The elements with the same reference numerals in the drawings are denoted as similar elements. Unless otherwise stated, the figures in the attached drawings do not constitute a scale limitation.

DETAILED DESCRIPTION OF ILLUSTRATIVE EMBODIMENTS

In order to make the purpose, technical solutions, and advantages of the embodiments of the present application clearer, the following will clearly and completely describe the technical solutions in the embodiments of the present application with reference to the drawings in the embodiments of the present application. Obviously, the described embodiments are a part of the embodiments of the present invention, but not all of the embodiments. Based on the embodiments of the present invention, all other embodiments obtained by those of ordinary skill in the art without creative work shall fall within the protection scope of the present invention.

Figure 1:
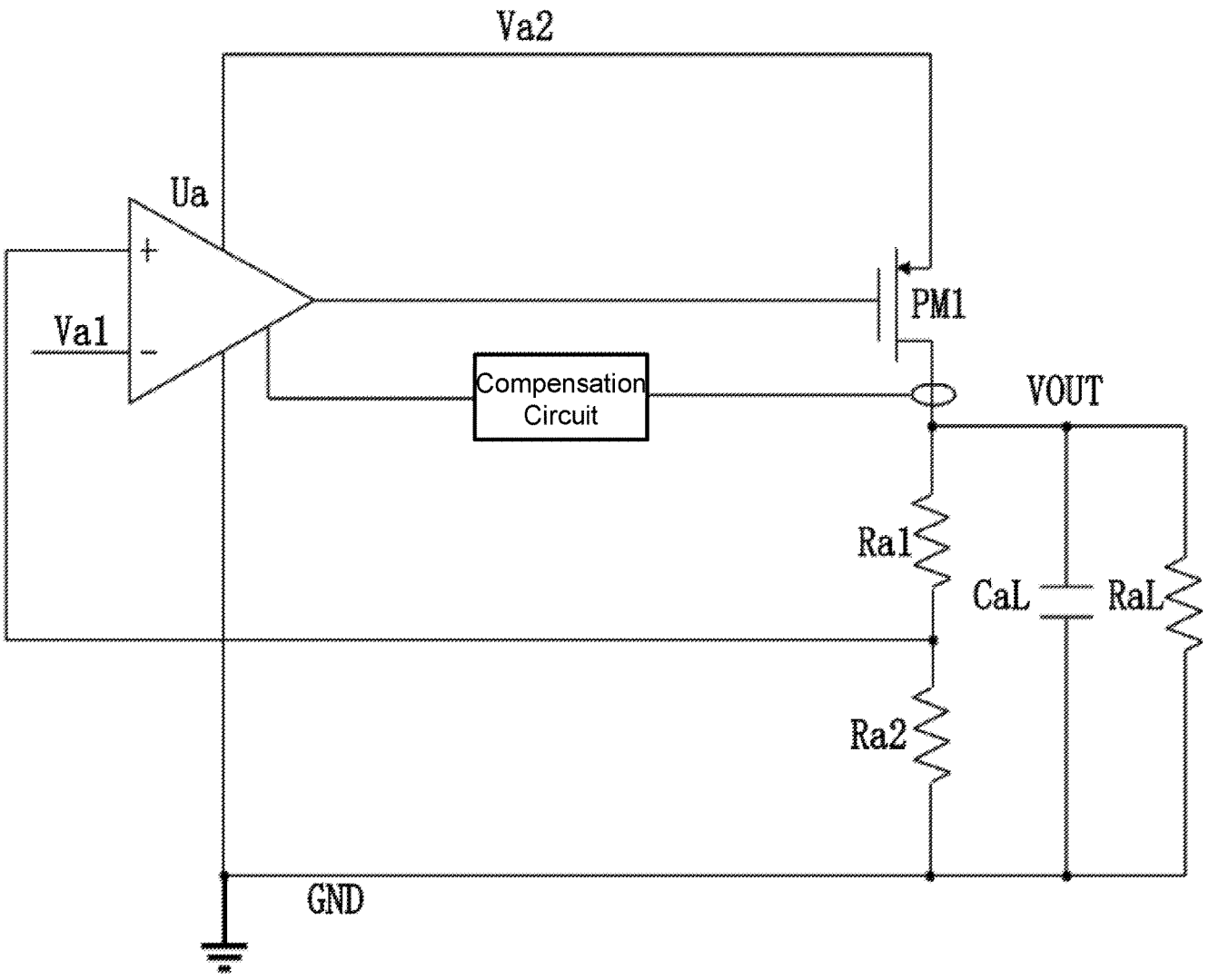
Figure 1 (Prior Art)
FIG. 1 is a schematic diagram of the circuit structure of a low-dropout linear regulator in the prior art.

Please refer to FIG. 1, which is a schematic diagram of a circuit structure of a low-dropout regulator (LDO) in the prior art. As shown in FIG. 1, the circuit structure of the low-dropout linear regulator essentially includes two poles. The first pole is formed by the output terminal of the error amplifier Ua, the high impedance output resistance and the parasitic gate capacitance of the power MOSFET PM1. The calculation equation for the frequency of this pole is:

$$f_{p1} = \frac{1}{2\pi C_{p1} R_{01}} \tag{1}$$

$C_{P1}$ is the capacitance value of the parasitic gate capacitance of the power MOSFET PM1. $R_{01}$ is the resistance value of the output resistance. $f_{P1}$ is the frequency of the first pole.

A second pole is formed by the output equivalent resistance RaL of the output terminal VOUT of the low-dropout linear regulator and the external capacitor CaL. The frequency of the second pole is calculated by:

$$f_{p2} = \frac{1}{2\pi C_L R_0} \tag{2}$$

$C_L$ is the capacitance value of the external capacitor CaL. $R_0$ is the resistance value of the equivalent resistor RaL. $f_{P2}$ is the frequency of the second pole.

It can be understood that in a circuit with a feedback loop, the capacitance on a circuit node will slow down the frequency response of the analog signal. A pole reflects the change in the output impedance. At a frequency lower than the pole frequency, the output impedance is determined by the output impedance of the circuit node, and at a frequency higher than the pole frequency, the output impedance is determined by the capacitance of the circuit node.

From Equation (1) and Equation (2), when the current of the load connected to the output terminal VOUT of the low-dropout linear regulator is small (the resistance value $R_0$ of the equivalent resistor RaL is large), the main pole is at the output terminal of the low-dropout linear regulator, which is determined by the capacitance value $C_L$ of the external capacitor CaL and the resistance value $R_0$ of the equivalent resistor RaL. However, the larger the power MOSFET PM1, the larger the parasitic capacitance $C_{P1}$ gets, which lowers the first pole frequency $f_{P1}$. This brings $f_{P1}$ closer to the second pole frequency $f_{P2}$. In the meantime, the smaller the quiescent current is, the larger the output resistance $R_{01}$ gets, which also drives $f_{P1}$ lower. Therefore, in order to make the regulation loop stable, there is a need to introduce a compensation circuit for stability compensation. The larger $R_{01}$ and $C_{P1}$ get, the stronger the compensation circuit needs to be, which makes the regulation loop bandwidth narrower and the dynamic response slower. In practical applications, the compensation circuit is usually a Miller compensation to separate $f_{P1}$ and $f_{P2}$ to achieve stability.

In addition, the dynamic response of the low-dropout linear regulator also depends on the slew rate of the gate of the power MOSFET PM1. The smaller the driving current of the power MOSFET is, or the larger the power MOSFET is, the more difficult it is to change the gate voltage to adjust the output current of the low-dropout linear regulator. Among them, the slew rate of the gate of the power MOSFET PM1 indicates when the load current changes, and how fast the gate voltage of the power MOSFET PM1 can change in order to adjust the output current of the low-dropout linear regulator to respond to the load current change.

In summary, the regulation loop stability and the dynamic response described above have become the limiting factors to the reduction of static power consumption. Furthermore, in the prior art, in order to maintain the regulation loop stability of the low-dropout linear regulator and improve its dynamic response under the condition of low static power consumption, it is usually necessary to set up a compensation circuit that can be dynamically adjusted as the load changes. The specific implementation process is: a control circuit senses the current of the power MOSFET PM1, and then controls the compensation circuit to obtain a dynamic zero to compensate the output pole, which can track the change of the output pole to achieve the stability across the full load range of the low-dropout linear regulator. In addition, through the sensed current, the drive capability of the error amplifier output can be controlled to change along with load changes so as to improve the transient response of the low-dropout linear regulator.

However, the scheme described above has the following disadvantages:

First, due to changes in temperature, process parameters, peripheral components and mismatches in the production process, the pole frequency of the regulation loop will change significantly. Therefore, it is difficult to ensure that the dynamic zero and the output pole are completely matched in the full load range. As a result, this technique is more difficult to realize loop compensation.

Second, the solution needs to adjust the dynamic bias to obtain sufficient drive capacity by sensing the load current change. However, to sense the change of the load current, the power MOSFET PM1 must react first, so there is no major improvement on the response speed of the initial change phase.

Third, the dynamic bias needs to add a feedback loop. This loop must ensure that the gain is less than 1. Otherwise, it will cause the low-dropout linear regulator to be unstable. Therefore, in the full load range, the dynamic bias gain cannot be too large. This limits the improvement of dynamic response speed.

Based on this, the present application provides a low-dropout linear regulator, which can automatically switch between different switch modules according to the level of the load to produce the current and voltage required by different loads, so that it not only lowers the static power consumption, which enables the low-dropout linear regulator to cover a wide load range, it also makes the zero-pole compensation of the low-dropout linear regulator easier, and at the same time, it can also improve the speed of dynamic response.

Figure 2:
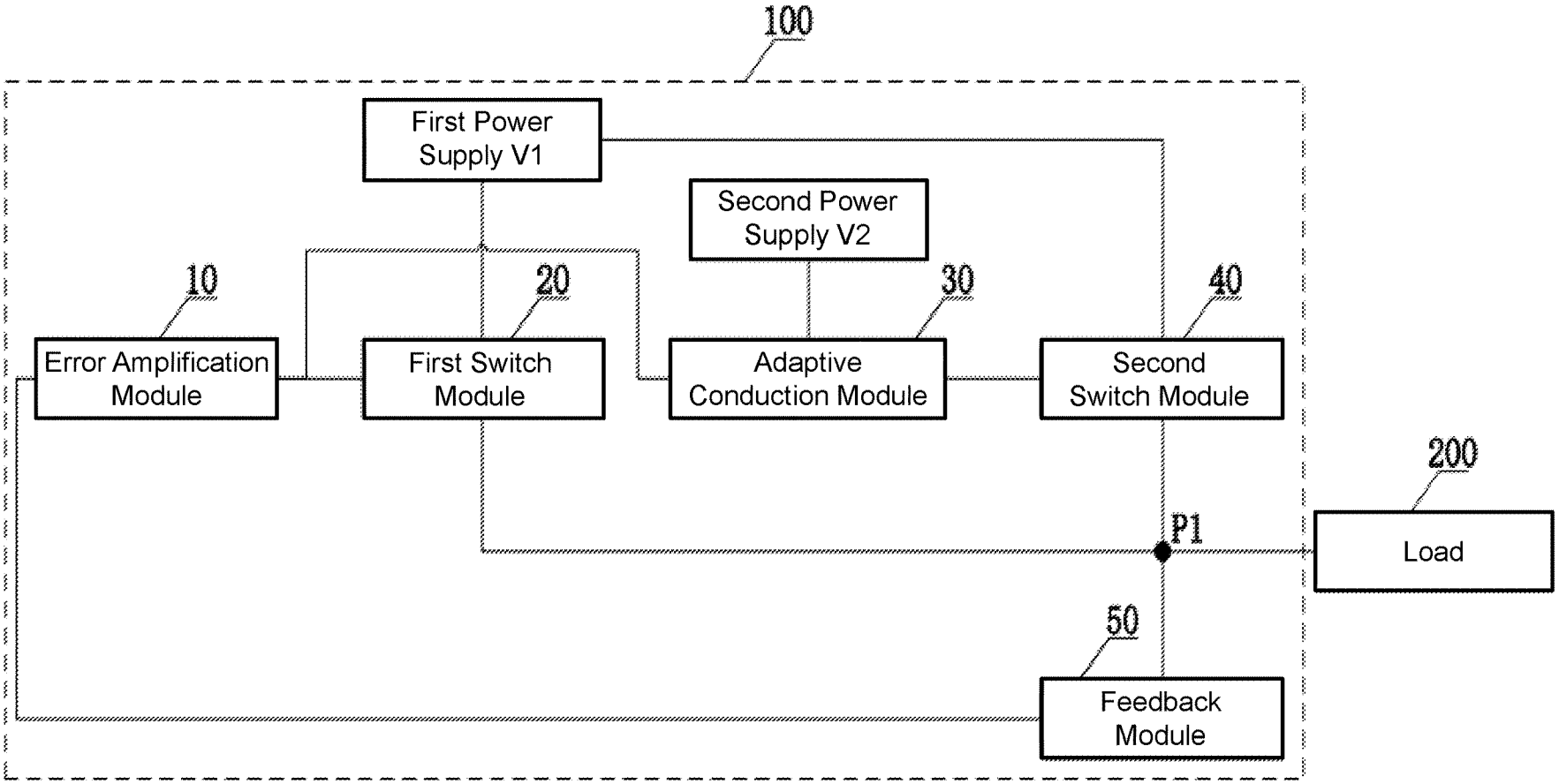
FIG. 2 is a schematic structural diagram of a low-dropout linear regulator provided by an embodiment of the present invention.

As shown in FIG. 2, the low-dropout linear regulator 100 includes an error amplification module 10, a first switch module 20, an adaptive conduction module 30, a second switch module 40 and a feedback module 50. An input terminal of the error amplification module 10 is connected to a first terminal of the feedback module 50. A first terminal of the first switch module 20 is connected to an output terminal of the error amplification module 10. A second terminal of the first switch module 20 is connected to a first power supply V1. A first terminal of the adaptive conduction module 30 is connected to an output terminal of the error amplification module 10. A second terminal of the adaptive conduction module 30 is connected to a second power supply V2. A third terminal of the adaptive conduction module 30 is connected to a first terminal of the second switch module 40. A second terminal of the second switch module 40 is connected to the first power supply V1. A third terminal of the first switch module 20 is connected to a third terminal of the second switch module 40, a second terminal of the feedback module 50 and the load 200. The connection node between the third terminal of the first switch module 20, the third terminal of the second switch module 40, the second terminal of the feedback module 50 and the load is the first connection node P1.

The first power supply V1 and the second power supply V2 can be the same or different. The first power supply V1 and the second power supply V2 can be based on a voltage from the low-dropout linear regulator 100, or can be from a separate power supply. At the same time, the second power supply V2 can also be the power supply of the error amplification module 10.

Specifically, the feedback module 50 obtains a feedback signal according to the voltage at the first connection node P1. The error amplification module 10 then outputs a control voltage signal according to the feedback signal output by the feedback module 50, and the first switch module 20 adjusts a first voltage difference between the second terminal and the third terminal of the first switch module 20 according to the control voltage signal generated by the error amplification module 10. The adaptive conduction module 30 is used to perform an adaptive potential conversion on the control voltage signal output by the error amplification module 10 to adjust a second voltage difference between the second terminal and the third terminal of the second switch module 40. It can be seen that, on the one hand, the control voltage signal output by the error amplifier module 10 is directly used to adjust the first voltage difference, and on the other hand, it is first sent to the adaptive conduction module 30, after the potential conversion is performed on the control voltage signal by the adaptive conduction module 30. The converted control voltage signal is then used to control the second switch module 40. The potential conversion of the control voltage signal by the adaptive conduction module 30 enables that the same control voltage signal can realize the conduction of the first switch module 20 and the second switch module 40 at different control voltage levels.

Furthermore, the first voltage difference or the second voltage difference is used to adjust the voltage on the first connection node P1 to satisfy different loads conditions. Different loads mainly refer to loads with different required supply currents. At the same time, the load may also refer to electrical equipment. For example, the load may be an integrated chip. The low-dropout linear regulator can provide a stable operating voltage for the integrated circuit chip.

In practical applications, when the load current is less than a preset current threshold, the control voltage signal output by the error amplification module 10 controls the first switch module 20 to turn on, and the adaptive conduction module 30 controls the second switch module 40 to turn off. The voltage at the first connection node P1 is adjusted based on a first voltage difference.

When the load current is greater than or equal to the preset current threshold, the control voltage signal output by the error amplification module 10 keeps the first switch module 20 to be turned on, and the adaptive conduction module 30 controls the second switch module 40 to be turned on. The voltage at the first connection node P1 is adjusted based on the first voltage difference and a second voltage difference.

The load current refers to the current flowing from the first connection node to the load 200. Therefore, when the load current is less than the preset current threshold, it can be regarded as a light load. At this time, by only turning on the first switch module 20, lower static power consumption can be achieved. Meanwhile, since the current required by the light load is relatively low, the first switch module 20 can be correspondingly configured as a switch module with larger on-resistance and lower power rating to further reduce static power consumption. At the same time, the parasitic gate capacitance of the first switch module with lower power $C_{P1}$ is also relatively small, and its corresponding pole is easier to compensate.

When the load current is greater than or equal to the preset current threshold, it can be considered as a heavy load. Only turning on the first switch module 20 cannot meet the current required by the load. At this time, not only the first switch module 20 is turned on, but also the second switch module 40 is turned on by the adaptive conduction module 30 to provide a larger output current to the load.

As the load current continues to increase, the on-resistance of the second switch module 40 also decreases as the control voltage signal changes. Since the on-resistance of the second switch module 40 is usually smaller than that of the first switch module 20, as the load current increases, a larger proportion of the load current will be supplied to the load through the second switch module 40. At this time, the voltage on the first connection node P1 is also mainly determined by the conduction characteristics of the second switch module 40 (e.g., the second voltage difference).

It can be understood that, in all the embodiments of the present application, the level of the load refers to the current required by the load.

In summary, first, when the low-dropout linear regulator is connected to a light load, only the first switch module 20 is turned on to achieve lower static power consumption. In other words, the low-dropout linear regulator 100 has low power consumption.

Secondly, the low-dropout linear regulator 100 can be applied to both light loads and heavy loads, so it can cover a wide load range.

Furthermore, the adaptive conduction module 30 changes the operating state of the second switch module 40 according to the change of the load current. Then, on one hand, the adaptive conduction module 30 will not affect the overall power consumption of the low-dropout linear regulator. On the other hand, the switching of the operating state of the adaptive conduction module 30 depends only on its own characteristics, and has nothing to do with peripheral components, so the low-dropout linear regulator 100 has high portability.

Figure 3:
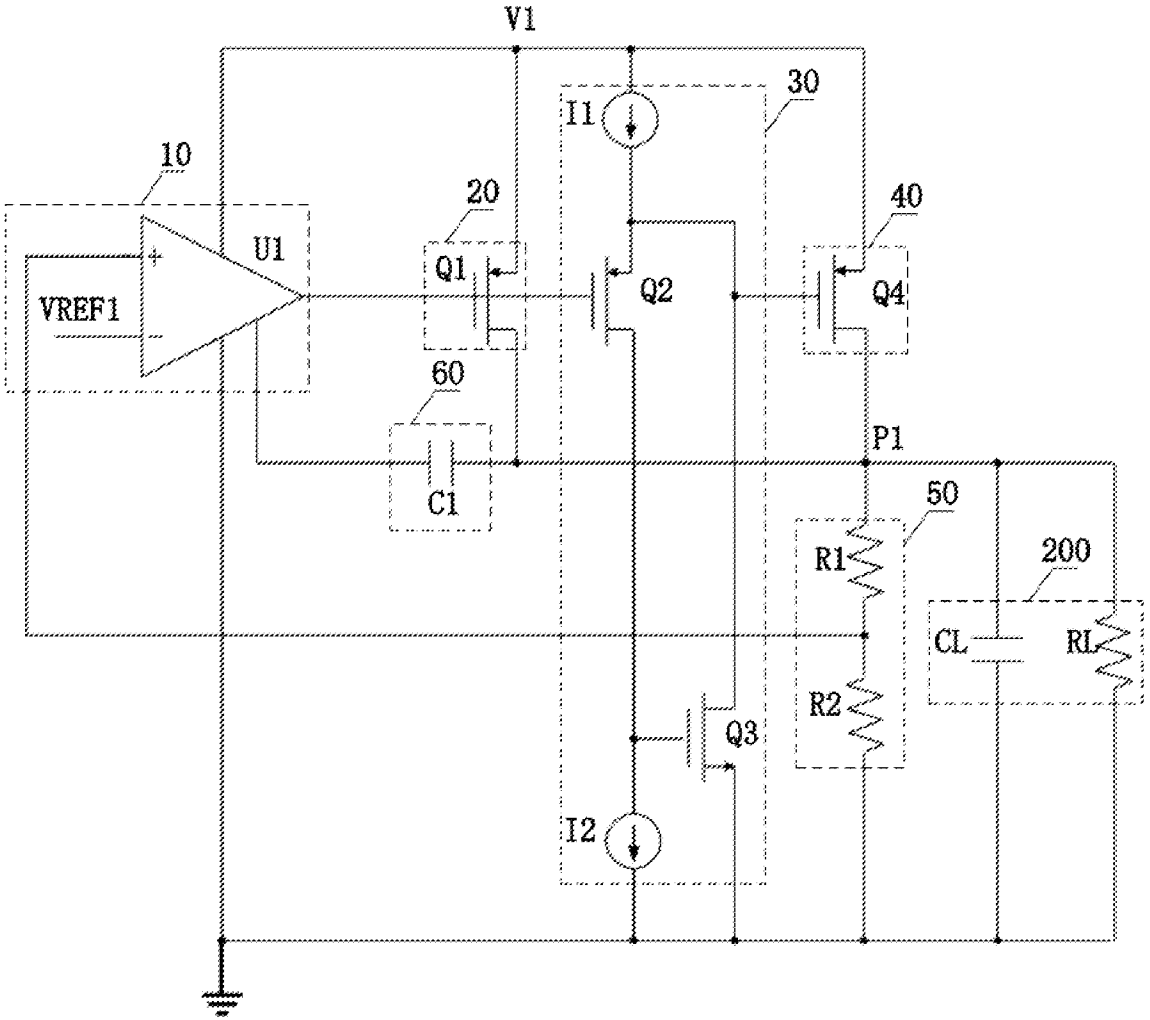
FIG. 3 is a schematic diagram of the circuit structure of a low-dropout linear regulator provided by an embodiment of the present invention.

In one embodiment, as shown in FIG. 3, the error amplifier module 10 includes a first error amplifier U1. The non-inverting input terminal of the first error amplifier U1 is connected to the first terminal of the feedback module 50. The inverting input terminal of the first error amplifier U1 is connected to the first reference voltage source VREF1. The output terminal of the first error amplifier U1 is connected to the first terminal of the first switch module 20 and the first terminal of the adaptive conduction module 30.

When the load is light, the voltage on the first connection node P1 is higher, and the voltage fed back to the non-inverting input terminal of the first error amplifier U1 is also higher. The voltage of the control voltage signal generated by the first error amplifier U1 at its output terminal is also higher. As the load current increases, the voltage on the first connection node P1 is pulled down, and the voltage fed back by the feedback module 50 to the non-inverting input terminal of the first error amplifier U1 also decreases. As a result, the control voltage signal generated by the first error amplifier U1 at its output terminal is also reduced.

Optionally, the feedback module 50 includes a first resistor R1 and a second resistor R2. The first resistor R1 and the second resistor R2 are connected in series. The non-series connection terminal of the first resistor R1 is connected to the first connection node P1. The connection node between the first resistor R1 and the second resistor R2 is connected to the non-inverting input terminal of the first error amplifier U1 in the error amplification module 10. The non-series connection terminal of the second resistor R2 is grounded. The connection node between the first resistor R1 and the second resistor R2 is the first terminal of the feedback module 50.

The voltage divider circuit comprising the first resistor R1 and the second resistor R2 divides the voltage on the first connection node P1. The voltage at the first connection node P1 across the second resistor R2 is sent to the non-inverting input terminal of the first error amplifier U1, so that the magnitude of the control voltage signal generated by the error amplifier module 10 at its output terminal is determined by the voltage on the first connection node P1. That is, since the input of the inverting input terminal of the first error amplifier U1 is the first reference voltage VREF1 (which is a fixed value), then, if the voltage on the first connection node P1 increases, the control voltage signal output from the output terminal of the first error amplifier U1 also increases. Conversely, if the voltage at the first connection node P1 decreases, the voltage of the control voltage signal output from the output terminal of the first error amplifier U1 also decreases.

Optionally, the first switch module includes a first MOSFET. Taking the first switch module 20 shown in FIG. 3 as an example, the first MOSFET corresponds to the PMOS Q1.

Specifically, the gate of the PMOS Q1 is connected to the output terminal of the error amplification module 10. The source of the PMOS Q1 is connected to the second power supply V2 (or the first power supply V1). The drain of the PMOS Q1 is connected to the first connection node P1. The input of the gate of the PMOS Q1 is the control voltage signal output by the error amplification module 10. When the PMOS Q1 is operating in the linear region, at this time, the PMOS Q1 is equivalent to a variable resistance connected between its source and drain controlled by the control voltage signal. That is, the resistance between the source and drain of the PMOS Q1 changes with the change of the control voltage signal, so that the control voltage signal can adjust the voltage drop between the source and the drain of the PMOS Q1. Therefore, the control voltage signal output by the error amplification module 10 can adjust the voltage drop between the source and the drain of the PMOS Q1.

Optionally, the adaptive conduction module 30 includes a second MOSFET, a third MOSFET, a first current source, and a second current source. Take the circuit structure of the adaptive conduction module 30 shown in FIG. 3 as an example. The second MOSFET corresponds to the PMOS Q2. The third MOSFET corresponds to the NMOS Q3. The first current source corresponds to the first current source I1. The second current source corresponds to the second current source I2.

Specifically, the gate of the PMOS Q2 is connected to the output terminal of the error amplification module 10. The source of the PMOS Q2 is connected to the anode of the first current source I1 and the drain of the NMOS Q3. The cathode of the first current source I1 is connected to the second power supply V2 (or the first power supply V1). The drain of the PMOS Q2 is connected to the cathode of the second current source I2 and the gate of the NMOS Q3. The source of the NMOS Q3 and the anode of the second current source I2 are both grounded. Among them, the gate of the PMOS Q2 is the first terminal of the adaptive conduction module 30. The cathode of the first current source I1 is the second terminal of the adaptive conduction module 30. The anode of the first current source I1 is the third terminal of the adaptive conduction module 30. It should be understood that, in this embodiment, the first power supply V1 and the second power supply V2 are set to be equal. That is, the first power supply V1 and the second power supply V2 can be directly connected.

When the load is light, since the current flowing through the PMOS Q2 is less than the current output by the second current source I2, the voltage of the source of the PMOS Q2 will be pulled to the same voltage as the first power supply V1. As the load continues to increase, the current flowing through the PMOS Q2 continues to increase. When the current of the PMOS Q2 is equal to the current output by the second current source I2, the NMOS Q3 is gradually turned on.

Optionally, the second switch module 40 includes a fourth MOSFET. Taking the circuit structure of the second switch module 40 shown in FIG. 3 as an example, the fourth MOSFET corresponds to the PMOS Q4.

Specifically, the gate of the PMOS Q4 is connected to the anode of the first current source I1. The source of the PMOS Q4 is connected to the first power supply V1. The drain of the PMOS Q4 is connected to the first connection node P1.

When the load is light, the control voltage signal output by the output terminal of the first error amplifier U1 is relatively high. That is, the gate voltage of the PMOS Q1 and the gate voltage of the PMOS Q2 are both relatively high. Among them, PMOS Q1 and PMOS Q2 can be turned on, and the higher gate voltage of the PMOS Q2 will not allow the PMOS Q4 to turn on. Then, only the PMOS Q1 is conducting at this time, and the load current is provided by the PMOS Q1.

As the load current increases, the gate voltage of the PMOS Q1 and the gate voltage of the PMOS Q2 will gradually decrease. The source voltage of the PMOS Q2 will also decrease, and the gate voltage of the PMOS Q4 will also decrease. And when it drops to the turn-on voltage of the PMOS Q4, the PMOS Q4 begins to gradually turn on. Then, at this time, the PMOS Q1 and the PMOS Q4 are both in the operating state, and both are in the linear region. The load current is provided by the PMOS Q1 and the PMOS Q4 together.

It can be understood that in FIG. 3, when the first MOSFET is a PMOS, the gate of the PMOS Q1 is the control terminal of the first MOSFET. The source of the PMOS Q1 is the first terminal of the first MOSFET, and the drain of PMOS Q1 is the second terminal of the first MOSFET.

When the second MOSFET is a PMOS, the gate of the PMOS Q2 is the control terminal of the second MOSFET. The source of the PMOS Q2 is the first terminal of the second MOSFET. The drain of the PMOS Q2 is the second terminal of the second MOSFET.

When the third MOSFET is an NMOS, the gate of the NMOS Q3 is the control terminal of the third MOSFET. The source of the NMOS Q3 is the first terminal of the third MOSFET. The drain of the NMOS Q3 is second terminal of the third MOSFET.

When the fourth MOSFET is a PMOS, the gate of the PMOS Q4 is the control terminal of the fourth MOSFET. The source of the PMOS Q4 is the first terminal of the fourth MOSFET. The drain of the PMOS Q4 is the second terminal of the fourth MOSFET.

Of course, in other embodiments, the first MOSFET, the second MOSFET, the third MOSFET, and the fourth MOSFET can also use switching elements such as triode or IGBT MOSFET, and the actual application situation is similar when MOSFETs are used, which are within the scope that is easily understood by those skilled in the art.

Meanwhile, the load 200 in FIG. 3 includes a load capacitor CL and a load resistor RL. The load capacitor CL and the load resistor RL are an equivalent form of the actual load (electric equipment). Moreover, when the voltage output by the low-dropout linear regulator 100 is stable, that is, the voltage remains constant, the larger the load current, the smaller the load resistance RL.

In practical applications, the first connection node P1 is used to connect the load 200. When the load is light, the voltage at the first connection node P1 is divided by the feedback module 50 and the feedback signal is input to the non-inverting input terminal of the first error amplifier U1, so that the first error amplifier U1 outputs a control voltage signal to control the gate voltage of the PMOS Q1, which generates a corresponding voltage drop between the source and drain of the PMOS Q1. Then, the voltage at the first connection node P1 can be obtained by subtracting the voltage drop of the PMOS Q1 from the first power supply V1. Therefore, when the difference between the feedback signal and the first reference voltage VREF1 is stable, the voltage on the first connection node P1 is stable. The voltage on the first connection node P1 is:

$$V_{P1}=\text{VREF1}*(1+r_{R1}/r_{R2})$$

$V_{P1}$ is the voltage on the first connection node P1. $r_{R1}$ is the resistance value of the first resistor R1, and $r_{R2}$ is the resistance value of the second resistor R2.

Moreover, when the load is light, since the gate voltage of the PMOS Q2 is relatively high, it is not enough to turn on the PMOS Q4. Thus, in this case only the PMOS Q1 is turned on. It can be seen from Equation (1) in the prior art. CP1 can be controlled at a relatively small capacitance value by controlling the size of the PMOS Q1 to ensure that the frequencies of the two poles $f_{P1}$ and $f_{P2}$ have a large difference, thereby ensuring the circuit stability of the low-dropout linear regulator. At the same time, the first error amplifier U1 only needs to drive the PMOS Q1. When the load changes, if the size of the PMOS Q1 is designed to be small, then the gate voltage of the PMOS Q1 can respond quickly. That is, the dynamic response speed of the circuit in the low-dropout linear regulator is not directly limited by the quiescent current of the first error amplifier U1, so that the excellent dynamic response speed can still be maintained under the premise of low quiescent current (power consumption)

Furthermore, as the load current increases, the gate voltage of the PMOS Q2 gradually decreases, and the source voltage of the PMOS Q2 (also the gate voltage of the PMOS Q4) will decrease synchronously. When it drops to the turn-on voltage of the PMOS Q4, the PMOS Q4 starts to turn on, and the load current starts to be provided by the PMOS Q1 and the PMOS Q4. That is, as the load current increases, the current provided by the PMOS Q1 is no longer sufficient to support the current required by the load, so the gate voltage of the PMOS Q2 is reduced to gradually turn on the PMOS Q4, so that more current can be provided to load to ensure stable output voltage and the stability of the control loop in the low-dropout linear regulator.

The conduction condition of the PMOS Q4 can be approximately expressed as:

$$V_{SG_PM4}=v1-[(v1-V_{SG_PM1})+V_{SG_PM2}]=V_{SG_PM1}-V_{SG_PM2}>V_{TH_PM4}$$

$V_{SG_PM4}$ is the voltage between the source and the gate of the PMOS Q4. v1 is the voltage of the first power supply V1. $V_{SG_PM1}$ is the voltage between the source and the gate of the PMOS Q1, and $V_{SG_PM2}$ is the voltage between the source and the gate of the PMOS Q2. $V_{TH_PM4}$ is the turn-on voltage of the PMOS Q4. It can be seen that the voltage between the source and the gate of the PMOS Q4 is the difference between the voltage between the source and the gate of the PMOS Q1 and the voltage between the source and the gate of the PMOS Q2. When the difference between the voltage between the source and the gate of the PMOS Q1 and the voltage between the source and the gate of the PMOS Q2 is greater than the turn-on voltage of the PMOS Q4, the PMOS Q4 starts to conduct.

Further, after the low-dropout linear regulator reaches a stable state, the current flowing through the PMOS Q2 is the output current of the second current source I2, and the current flowing through the NMOS Q3 is the current of the first current source I1 minus the current of the second current source I2. When the PMOS Q2 operates in the saturation region, $V_{SG_PM2}$ can be expressed as:

$$V_{SG_PM2} = \sqrt{\frac{2 \cdot I20}{\mu_P C_{OX} \frac{W1}{L1}}} + V_{TH_PM2} \tag{3}$$

$\mu_P$ represents hole mobility. $C_{OX}$ represents gate oxide capacitance. W1 represents the width of PMOS Q2. L1 represents the length of PMOS Q2. I20 is the output current of the second current source I2. Therefore, when the PMOS Q2 is turned on, the difference between the voltage between the source and the gate of the PMOS Q1 and the voltage between the source and the gate of the PMOS Q4 is a fixed $V_{SG_PM2}$. Moreover, it can be known from Equation (3) that the voltage between the source and the gate of the PMOS Q2 is controlled by the output current I20 of the second current source I2. In other words, the current of the second current source I2 can control the voltage between the source and the gate of the PMOS Q2 to adjust the voltage difference between the source and the gate of the PMOS Q1 and the source and the gate of the PMOS Q4. Therefore, the PMOS Q1 and the PMOS Q4 can start to conduct at different voltage values of the control voltage signal.

In summary, in the above-mentioned embodiment, through setting the adaptive conduction module 30, there is a difference between the turn-on voltage between the PMOS Q1 and the PMOS Q4, and the feedback module 50 and the error amplification module 10 establish a connection between the difference and the load current, thereby realizing that the PMOS Q4 is automatically turned on or off when the output current is different (that is, the load current is different).

Therefore, when the load is light, only the PMOS Q1 is turned on, so that the power consumption of the low-dropout linear regulator is low. Moreover, because the load is light and the required current is small, then the PMOS Q1 can be set as a low-power transistor. On one hand, when the load changes, the gate voltage of the PMOS Q1 can respond quickly. On the other hand, it can further reduce static power consumption.

As the load current increases, the PMOS Q4 is turned on through the adaptive conduction module 30. At this time, the load current is provided by the PMOS Q1 and the PMOS Q4. In order to cover a wider load range, the PMOS Q4 can be set as a high-power MOSFET, and the power of PMOS Q1 and PMOS Q4 mainly depends on their size. In other words, by designing the size of the PMOS Q4 to be larger than the size of the PMOS Q1, the low-dropout linear regulator 100 can cover a wider load range. That is, the low-dropout linear regulator 100 can provide a larger current range to meet different load requirements.

At the same time, the adaptive conduction module 30 performs an automatic adjustment following the change of the load, so the adaptive conduction module 30 will not affect the overall power consumption of the low-dropout linear regulator 100. In addition, the bias current in the adaptive conduction module 30 can be larger. The bias current in the adaptive conduction module 30 is determined by the output current of the first current source I1 and the output current of the second current source I2. On one hand, the equivalent output impedance of the adaptive conduction module 30 can be reduced, so that the pole at the gate of the PMOS Q4 is pushed beyond the regulation loop bandwidth of the low-dropout linear regulator 100, and the regulation loop stability is guaranteed. On the other hand, the drive current of the high-power PMOS Q4 increases, and the slew rate of its gate is not limited by power consumption, which improves the overall dynamic response speed of the low-dropout linear regulator 100. That is, when the load current changes, the gate voltage of the PMOS Q4 also needs to be changed accordingly to adjust the output current. The speed of the voltage change of the gate of the PMOS Q4 depends on the bias current in the adaptive conduction module 30, so when set the output current of the first current source I1 and the output current of the second current source I2 to increase, the voltage of the gate of the PMOS Q4 can quickly change to respond to the needs of the regulation loop.

Optionally, the low-dropout linear regulator further includes a compensation module 60. The compensation module 60 is used to adjust the pole/zero of the low-dropout linear regulator.

The first terminal of the compensation module 60 is connected to the compensation terminal of the first error amplifier U1 in the error amplification module 10. The second terminal of the compensation module 60 is connected to the first connection node P1.

In practical applications, the compensation circuit usually adopts a Miller compensation to stabilize the low-dropout linear regulator. For example, in an embodiment, the compensation module 60 includes a compensation capacitor C1. The first terminal of the compensation capacitor C1 is connected to the compensation terminal of the first error amplifier U1. The second terminal of the compensation capacitor C1 is connected to the first connection node P1. By setting the compensation capacitor C1 to adjust the zero and pole of the low-dropout linear regulator, the stable operation of the low dropout linear regulator is realized.

It should be noted that the hardware structure of the low-dropout linear regulator 100 shown in FIG. 3 is only an example. The low-dropout linear regulator 100 may have more or less components, or two or more components are combined, or can have different component configurations. The various components shown in the FIG. 3 can be used in hardware, software, or a combination of hardware and software, including one or more signal processing and/or application specific integrated circuits.

Figure 4:
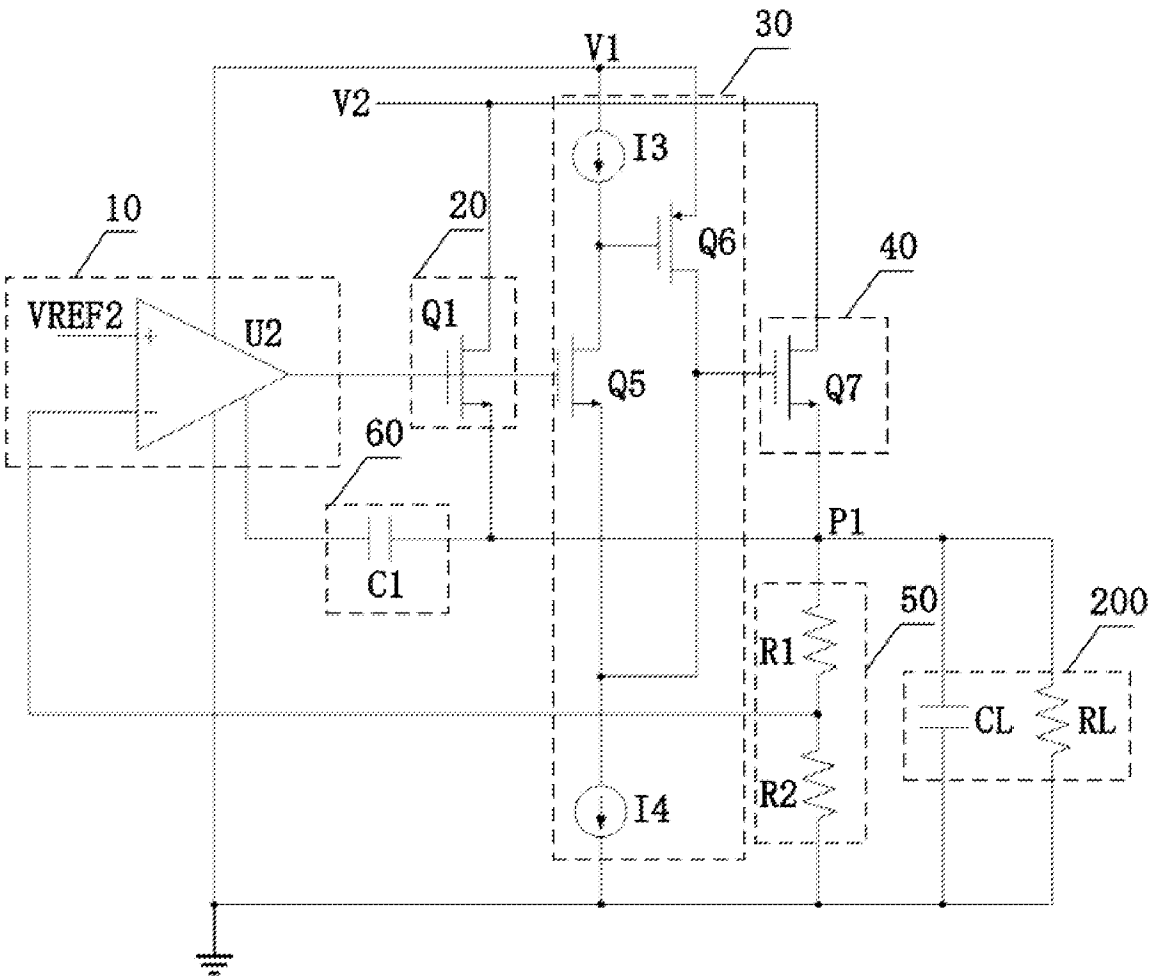
FIG. 4 is a schematic diagram of the circuit structure of a low-dropout linear regulator provided by another embodiment of the present invention.

For example, in one embodiment, as shown in FIG. 4, the error amplifier module 10 includes a second error amplifier U2. The inverting input terminal of the second error amplifier U2 is connected to the first terminal of the feedback module 50. The non-inverting input terminal of the second error amplifier U2 is connected to a second reference voltage source VREF2. The output terminal of the second error amplifier U2 is connected to the first terminal of the first switch module 20 and the first terminal of the adaptive conduction module 30.

When the load is light, the voltage at the first connection node P1 is high. The voltage fed back to the inverting input terminal of the second error amplifier U2 is also high, and the voltage of the control voltage signal output by the output terminal of the second error amplifier U2 is relatively low. As the load current increases, the voltage on the first connection node P1 is pulled down, and the voltage fed back by the feedback module 50 to the inverting input terminal of the second error amplifier U2 also decreases, and the control voltage signal generated by the second error amplifier U2 at its output terminal is increased.

Optionally, the feedback module 50 is the same as the embodiment in FIG. 3, which is within the scope that is easily understood by those skilled in the art and will not be repeated here.

Optionally, the first switch module 20 still includes a first MOSFET. The first MOSFET corresponds to the NMOS Q8. The gate of the NMOS Q8 is connected to the output terminal of the error amplification module 10. The drain of the NMOS Q8 is connected to the second power supply V2. The source of the NMOS Q8 is connected to the first connection node P1.

Similarly, the gate input of the NMOS Q8 is the control voltage signal output by the error amplification module 10. When the NMOS Q8 is operating in the linear region, at this time, the NMOS Q8 is equivalent to a variable resistor connected between its source and drain terminals that is controlled by the control voltage signal. The control voltage signal output by the error amplification module 10 can adjust the voltage drop between the source and the drain of the NMOS Q8.

Optionally, the adaptive conduction module 30 includes a fifth MOSFET, a sixth MOSFET, a third current source, and a fourth current source. In the circuit structure of the adaptive conduction module 30 shown in FIG. 4, the fifth MOSFET corresponds to the NMOS Q5. The sixth MOSFET corresponds to the PMOS Q6. The third current source corresponds to the third current source I3. The fourth current source corresponds to the fourth current source I4.

Specifically, the gate of the NMOS Q5 is connected to the output terminal of the error amplification module 10. The source of the NMOS Q5 is connected to the cathode of the fourth current source I4 and the drain of PMOS Q6. The drain of the NMOS Q5 is connected to the gate of the PMOS Q6 and the anode of the third current source I3. The source of PMOS Q6 is connected to the cathode of the third current source I3 and the first power supply V1. The anode of the fourth current source I4 is grounded. Among them, the gate of the NMOS Q5 is the first terminal of the adaptive conduction module 30. The cathode of the third current source I3 is the second terminal of the adaptive conduction module 30. The cathode of the fourth current source I4 is the third terminal of the adaptive conduction module 30.

Optionally, the second switch module 40 includes a seventh MOSFET. In FIG. 4, the seventh MOSFET corresponds to the NMOS Q7. The gate of the NMOS Q7 is connected to the cathode of the fourth current source I4. The source of the NMOS Q7 is connected to the first connection node P1. The drain of the NMOS Q7 is connected to the second power supply V2.

It should be noted that in the low-dropout linear regulator shown in FIG. 4, the first power supply V1 and the second power supply V2 are two separate power supplies with different voltage levels. This is because the driving of the NMOS requires a higher voltage. If the same voltage source is used, the voltage between the source and the drain of the NMOS will increase, and the purpose of low dropout cannot be achieved.

Specifically, when the load is light, since the gate voltage of the NMOS Q8 minus the voltage between the gate and the source of the NMOS Q5 is the gate voltage of the NMOS Q7, it can be seen that the gate voltage of the NMOS Q7 is relatively low, which is not enough to turn on the NMOS Q7. As the load continues to increase, the gate voltage of the NMOS Q8 will gradually increase, and the gate voltage of the NMOS Q7 will also increase. When it rises to the turn-on voltage of the NMOS Q7, the NMOS Q7 starts to conduct.

It should be understood that in FIG. 4, when the first MOSFET is an NMOS, the gate of the NMOS Q8 is the control terminal of the first MOSFET. The source of the NMOS Q8 is the first terminal of the first MOSFET. The drain of the NMOS Q8 is the second terminal of the first MOSFET.

When the fifth MOSFET is an NMOS, the gate of the NMOS Q5 is the control terminal of the fifth MOSFET. The source of the NMOS Q5 is the first terminal of the fifth MOSFET. The drain of the NMOS Q5 is the second terminal of the fifth MOSFET.

When the sixth MOSFET is a PMOS, the gate of the PMOS Q6 is the control terminal of the sixth MOSFET. The source of the PMOS Q6 is the first terminal of the sixth MOSFET. The drain of the PMOS Q6 is the second terminal of the sixth MOSFET.

When the seventh switch is an NMOS, the gate of NMOS Q7 is the control terminal of the seventh switch. The source of NMOS Q7 is the first terminal of the seventh switch. The drain of NMOS Q7 is the second terminal of the seventh switch.

In practical applications, the load 200 is also connected through the first connection node P1. When the load is light, the voltage at the first connection node P1 is divided by the feedback module 50, and the feedback signal is sent to the inverting input terminal of the second error amplifier U2, so that the second error amplifier U2 outputs a control voltage signal to control the gate voltage of the NMOS Q8, which causes a corresponding voltage drop between the source and drain of the NMOS Q8. Then, the voltage at the first connection node P1 can be obtained by subtracting the voltage drop of the NMOS Q8 from the second power supply V2. Therefore, when the difference between the feedback signal and the second reference voltage VREF2 becomes stable, the voltage on the first connection node P1 becomes stable, and the voltage on the first connection node P1 is:

$$V_{P1}=\text{VREF2}*(1+r_{R1}/r_{R2})$$

$V_{P1}$ is the voltage on the first connection node P1. $r_{R1}$ is the resistance value of the first resistor R1, and $r_{R2}$ is the resistance value of the second resistor R2.

In addition, when the load is light, the gate voltage of the NMOS Q7 is low, which is not enough to turn on the NMOS Q7. Then, in this case, only the NMOS Q8 is turned on. As the load current increases, the gate voltage of the NMOS Q8 gradually rises, and the gate voltage of the NMOS Q7 also gradually rises. When it rises to the turn-on voltage of the NMOS Q7, the NMOS Q7 starts to conduct. The load current begins to be provided by two power MOSFETs, NMOS Q7 and NMOS Q8. That is, as the load current increases, the current provided by the NMOS Q8 is no longer sufficient to support the current required by the load, so the gate voltage of the NMOS Q8 is increased to gradually turn on the NMOS Q7, thereby providing more current to ensure the stability of the output voltage and the stability of the control loop in the low-dropout linear regulator.

Among them, the conduction condition of the NMOS Q7 can be approximately expressed as the following:

$$V_{GS_NM7}=V_{GS_NM8}-V_{GS_NM5}>V_{TH_NM7}$$

$V_{GS_NM7}$ is the voltage between the gate and the source of the NMOS Q7. $V_{GS_NM8}$ is the voltage between the gate and the source of the NMOS Q8, and $V_{GS_NM5}$ is the voltage between the gate and the source of the NMOS Q5. $V_{TH_NM7}$ is the turn-on voltage of the NMOS Q7. It can be seen that the voltage between the gate and the source of the NMOS Q7 is the difference between the voltage between the gate and the source of the NMOS Q8, and the voltage between the gate and the source of the NMOS Q5. When the voltage between the gate and the source of the NMOS Q7 is greater than the turn-on voltage of the NMOS Q7, the NMOS Q7 starts to conduct.

Further, after the low-dropout linear regulator reaches a stable state, the current flowing through the NMOS Q5 is the output current of the fourth current source I4, and the current flowing through the PMOS Q6 is the current of the third current source I3 minus the current of the fourth current source I4. When the NMOS Q5 operates in the saturation region, $V_{GS_NM5}$ can be expressed as:

$$V_{GS_NM5} = \sqrt{\frac{2 \cdot I21}{\mu_n C_{OX} \frac{W2}{L2}}} + V_{TH_NM5} \tag{4}$$

$\mu_n$ represents the electron mobility. $C_{OX}$ represents the gate oxide capacitance. W2 represents the width of the NMOS Q5. L2 represents the length of the NMOS Q5, and I21 is the output current of the fourth current source I4. Therefore, when the NMOS Q5 is turned on, the difference between the voltage between the source and the gate of the NMOS Q8, and the voltage between the source and the gate of the NMOS Q7 is a fixed $V_{GS_NM5}$. Moreover, it can be seen from the Equation (4) that the voltage between the gate and the source of the NMOS Q5 is controlled by the output current I21 of the fourth current source I4. All in all, the current of the fourth current source I4 can control the voltage between the source and the gate of the NMOS Q5, to realize the adjustment of the difference between the voltage between the gate and the source of the NMOS Q8, and the voltage between the gate and the source of the NMOS Q7, so that the NMOS Q8 and the NMOS Q7 can be controlled to turn on according to different control voltage signals.

At the same time, the size of the NMOS Q8 can also be set smaller than the size of the NMOS Q7.

Obviously, the circuit structure of the low-dropout linear regulator shown in FIG. 4 is also realized: by configuring the adaptive conduction module 30, there is a difference between the turn-on voltages of the NMOS Q8 and the NMOS Q7. The feedback module 50 and the error amplification module 10 establish a connection between the difference and the load current, so that the NMOS Q7 is automatically turned on or off at different output currents (that is, different load currents). Then, the low-dropout linear regulator shown in FIG. 4 can also achieve the same beneficial effects as the low-dropout linear regulator shown in FIG. 3. It is within the scope easily understood by those skilled in the art and will not be repeated here.

Similarly, the low-dropout linear voltage stabilization shown in FIG. 4 can also add a compensation module 60. The specific implementation process is similar to the embodiment shown in FIG. 3 and will not be repeated here.

An embodiment of the application also provides a control system, which includes a load and a low-dropout linear regulator as in any of the above embodiments, where the low-dropout linear regulator is connected to the load. The low-dropout linear regulator is used to provide voltage and current to the load.

Finally, it should be noted that the above embodiments are only used to illustrate the technical solutions of the present invention, not to limit them; under the idea of the present invention, the technical features of the above embodiments or different embodiments can also be combined. The steps can be implemented in any order, and there are many other variations of the different aspects of the present invention as described above. For the sake of brevity, they are not provided in the details; although the present invention has been described in detail with reference to the foregoing embodiments, it is common that the technical personnel should understand that: they can still modify the technical solutions recorded in the foregoing embodiments, or equivalently replace some of the technical features; and these modifications or substitutions do not make the essence of the corresponding technical solutions deviate from the implementations of this application examples of the scope of technical solutions.

What is claimed is:

1. A low-dropout linear regulator comprising:

an error amplification module, a first switch module, an adaptive conduction module, a second switch module and a feedback module, wherein:

an input terminal of the error amplification module is connected to a first terminal of the feedback module;

the error amplification module is configured to output a control voltage signal according to a feedback signal generated by the feedback module;

a first terminal of the first switch module is connected to an output terminal of the error amplification module;

a second terminal of the first switch module is connected to a first power supply;

the first switch module adjusts a first voltage difference between the second terminal and a third terminal of the first switch module according to the control voltage signal;

a first terminal of the adaptive conduction module is connected to the output terminal of the error amplification module;

a second terminal of the adaptive conduction module is connected to a second power supply;

a third terminal of the adaptive conduction module is connected to a first terminal of the second switch module;

a second terminal of the second switch module is connected to the first power supply;

the adaptive conduction module is used to perform an adaptive potential conversion on the control voltage signal to adjust a second voltage difference between the second terminal and a third terminal of the second switch module;

the third terminal of the first switch module is connected to the third terminal of the second switch module, a second terminal of the feedback module and a load, and wherein a connection node between the third terminal of the first switch module, the third terminal of the second switch module, the second terminal of the feedback module and the load is a first connection node, and the feedback signal is obtained by the feedback module according to a voltage on the first connection node, and wherein:

when a load current is less than a preset current threshold, the control voltage signal controls the first switch module to be turned on, and the adaptive conduction module controls the second switch module to be turned off to adjust the voltage on the first connection node based on the first voltage difference; and when the load current is greater than or equal to the preset current threshold, the control voltage signal controls the first switch module to be turned on, and the adaptive conduction module controls the second switch module to be turned on to adjust the voltage on the first connection node based on the first voltage difference and the second voltage difference.

2. The low-dropout linear regulator of claim 1, wherein:

the first switch module includes a first MOSFET;

a control terminal of the first MOSFET is connected to the output terminal of the error amplification module;

a first terminal of the first MOSFET is connected to the second power supply; and a second terminal of the first MOSFET is connected to the first connection node.

3. The low-dropout linear regulator of claim 2, wherein:

the adaptive conduction module includes a second MOSFET, a third MOSFET, a first current source and a second current source, and wherein:

a control terminal of the second MOSFET is connected to the output terminal of the error amplification module;

a first terminal of the second MOSFET is connected to a positive terminal of the first current source and a second terminal of the third MOSFET;

a negative terminal of the first current source is connected to the second power supply;

a second terminal of the second MOSFET is connected to a negative terminal of the second current source and a control terminal of the third MOSFET;

a first terminal of the third MOSFET and a positive terminal of the second current source are both grounded;

the control terminal of the second MOSFET is the first terminal of the adaptive conduction module;

the negative terminal of the first current source is the second terminal of the adaptive conduction module; and the positive terminal of the first current source is the third terminal of the adaptive conduction module.

4. The low-dropout linear regulator of claim 3, wherein:

the second switch module includes a fourth MOSFET, and wherein:

a control terminal of the fourth MOSFET is connected to the positive terminal of the first current source;

a first terminal of the fourth MOSFET is connected to the first power supply; and a second terminal of the fourth MOSFET is connected to the first connection node.

5. The low-dropout linear regulator of claim 4, wherein:

the first MOSFET is a first PMOS, and wherein a gate of the first PMOS is the control terminal of the first MOSFET, a source of the first PMOS is the first terminal of the first MOSFET, and a drain of the first PMOS is the second terminal of the first MOSFET;

the second MOSFET is a second PMOS, and wherein a gate of the second PMOS is the control terminal of the second MOSFET, a source of the second PMOS is the first terminal of the second MOSFET, and a drain of the second PMOS is the second terminal of the second MOSFET;

the third MOSFET is an NMOS, and wherein a gate of the NMOS is the control terminal of the third MOSFET, a source of the NMOS is the first terminal of the third MOSFET, and a drain of the NMOS is the second terminal of the third MOSFET; and the fourth MOSFET is a third PMOS, and wherein a gate of the third PMOS is the control terminal of the fourth MOSFET, a source of the third PMOS is the first terminal of the fourth MOSFET, and a drain of the third PMOS is the second terminal of the fourth MOSFET.

6. The low-dropout linear regulator of claim 5, wherein:

a current of the second current source is used to control a voltage between a gate and a source of the second MOSFET, so that the first MOSFET and the fourth MOSFET start to conduct under different voltage values of the control signal.

7. The low-dropout linear regulator of claim 5, wherein:

a size of the first MOSFET is smaller than a size of the fourth MOSFET.

8. The low-dropout linear regulator of claim 7, wherein:

the error amplification module includes a first error amplifier;

a non-inverting input terminal of the first error amplifier is connected to the first terminal of the feedback module;

an inverting input terminal of the first error amplifier is connected to a first reference voltage source; and an output terminal of the first error amplifier is connected to the first terminal of the first switch module and the first terminal of the adaptive conduction module.

9. The low-dropout linear regulator of claim 1, wherein:

the first switch module includes a first MOSFET;

a control terminal of the first MOSFET is connected to the output terminal of the error amplification module;

a first terminal of the first MOSFET is connected to the second power supply;

a second terminal of the first MOSFET is connected to the first connection node;

the adaptive conduction module includes a fifth MOSFET, a sixth MOSFET, a third current source, and a fourth current source;

a control terminal of the fifth MOSFET is connected to the output terminal of the error amplification module;

a first terminal of the fifth MOSFET is connected to a negative terminal of the fourth current source and a second terminal of the sixth MOSFET;

a second terminal of the fifth MOSFET is connected to a control terminal of the sixth MOSFET and a positive terminal of the third current source;

a first terminal of the sixth MOSFET is connected to a negative terminal of the third current source and the first power supply;

a positive terminal of the fourth current source is grounded;

the control terminal of the fifth MOSFET is the first terminal of the adaptive conduction module;

the negative terminal of the third current source is the second terminal of the adaptive conduction module; and the negative terminal of the fourth current source is the third terminal of the adaptive conduction module.

10. The low-dropout linear regulator of claim 9, wherein the second switch module includes a seventh MOSFET;

a control terminal of the seventh MOSFET is connected to the negative terminal of the fourth current source;

a first terminal of the seventh MOSFET is connected to the first connection node; and a second terminal of the seventh MOSFET is connected to the second power supply.

11. The low-dropout linear regulator of claim 10, wherein:

the first MOSFET is a first NMOS, and wherein a gate of the first NMOS is the control terminal of the first MOSFET, a drain of the first NMOS is the first terminal of the first MOSFET, and a source of the first NMOS is the second terminal of the first MOSFET;

the fifth MOSFET is a second NMOS, and wherein a gate of the second NMOS is the control terminal of the fifth MOSFET, a source of the second NMOS is the first terminal of the fifth MOSFET, and a drain of the second NMOS is the second terminal of the fifth MOSFET;

the sixth MOSFET is a PMOS, and wherein a gate of the PMOS is the control terminal of the sixth MOSFET, a source of the PMOS is the first terminal of the sixth MOSFET, and a drain of the PMOS is the second terminal of the sixth MOSFET; and the seventh MOSFET is a third NMOS, and wherein a gate of the third NMOS is the control terminal of the seventh MOSFET, a source of the third NMOS is the first terminal of the seventh MOSFET, and a drain of the third NMOS is the second terminal of the seventh MOSFET.

12. The low-dropout linear regulator of claim 11, wherein:

the error amplification module includes a second error amplifier;

an inverting input terminal of the second error amplifier is connected to the first terminal of the feedback module;

a non-inverting input terminal of the second error amplifier is connected to a second reference voltage source; and an output terminal of the second error amplifier is connected to the first terminal of the first switch module and the first terminal of the adaptive conduction module.

13. The low-dropout linear regulator of claim 1, wherein:

the feedback module includes a first resistor and a second resistor;

the first resistor and the second resistor are connected in series;

a non-series connection terminal of the first resistor is connected to the first connection node;

a connection node between the first resistor and the second resistor is connected to the input terminal of the error amplification module;

a non-series connection terminal of the second resistor is grounded; and a connection node between the first resistor and the second resistor is the first terminal of the feedback module.

14. The low-dropout linear regulator in claim 1, further comprising a compensation module, wherein:

a first terminal of the compensation module is connected to a compensation terminal of the error amplification module;

a second terminal of the compensation module is connected to the first connection node; and the compensation module is used to adjust zero and pole of the low-dropout linear regulator.

* * * * *